US011865404B2

(12) United States Patent
Hitman

(10) Patent No.: US 11,865,404 B2
(45) Date of Patent: Jan. 9, 2024

(54) EXERCISE BAR

(71) Applicant: Daniel Hitman, San Diego, CA (US)

(72) Inventor: Daniel Hitman, San Diego, CA (US)

( * ) Notice: Subject to any disclaimer, the term of this patent is extended or adjusted under 35 U.S.C. 154(b) by 338 days.

(21) Appl. No.: 17/168,716

(22) Filed: Feb. 5, 2021

(65) Prior Publication Data

US 2021/0154523 A1 May 27, 2021

Related U.S. Application Data

(63) Continuation of application No. PCT/US2019/045639, filed on Aug. 8, 2019, which is a continuation-in-part of application No. 29/659,336, filed on Aug. 8, 2018, now Pat. No. Des. 898,134.

(60) Provisional application No. 62/779,819, filed on Dec. 14, 2018.

(51) Int. Cl.
*A63B 21/00* (2006.01)
*A63B 21/072* (2006.01)

(52) U.S. Cl.
CPC ..... *A63B 21/4035* (2015.10); *A63B 21/0724* (2013.01); *A63B 2225/09* (2013.01)

(58) Field of Classification Search
CPC .. A63B 1/00; A63B 3/00; A63B 17/00; A63B 17/04; A63B 21/0004; A63B 21/00047; A63B 21/00058; A63B 21/00061; A63B 21/00065; A63B 21/072; A63B 21/0722; A63B 21/0724; A63B 21/078; A63B 21/0783; A63B 21/4023; A63B 21/4027; A63B 21/4033; A63B 21/4035; A63B 21/4043; A63B 23/12; A63B 23/1218; A63B 23/1236; A63B 2210/00; A63B 2210/50; A63B 2225/09; A63B 2225/093; A63B 2244/09
See application file for complete search history.

(56) References Cited

U.S. PATENT DOCUMENTS 3,384,370 A * 5/1968 Bailey ..... A63B 21/0724 482/106
4,461,473 A * 7/1984 Cole ..... A63B 21/0724 482/106
4,585,229 A 4/1986 Brasher
(Continued)

OTHER PUBLICATIONS

International Search Report and Written Opinion of the International Searching Authority issued for corresponding International Patent Application No. PCT/US2019/045639, dated Nov. 4, 2019.

*Primary Examiner* — Gary D Urbiel Goldner
(74) *Attorney, Agent, or Firm* — Myers Wolin, LLC

(57) ABSTRACT

An embodiment of the present disclosure provides an exercise bar. The exercise bar includes: a first end support; a second end support; a first handle support; and a second handle support. The second end support is spaced apart from the first end support in a first direction. The first handle support is located between the first end support and the second end support in the first direction. The second handle support is spaced apart from the first handle support in a second direction different from the first direction. The second handle support is located between the first end support and the second end support in the first direction. Each of the first handle support and the second handle support is configured to receive at least one of a plurality of adjustable handles.

23 Claims, 7 Drawing Sheets

(56) References Cited

U.S. PATENT DOCUMENTS 4,618,143 A * 10/1986 Twardosz ..... A63B 21/0724 482/106
4,629,184 A * 12/1986 Selkee ..... A63B 21/0724 482/106
4,690,400 A * 9/1987 Metz ..... A63B 21/00069 482/106
4,743,018 A 5/1988 Eckler
4,822,035 A * 4/1989 Jennings ..... A63B 21/0724 482/106
RE33,218 E * 5/1990 Twardosz ..... A63B 21/0724 482/106
5,118,097 A * 6/1992 Cousins ..... A63B 1/00 472/16
5,334,113 A * 8/1994 Roepke ..... A63B 21/4001 482/106
5,725,461 A 3/1998 Bogard, II
6,022,300 A * 2/2000 Hightower ..... A63B 21/0728 482/106
6,186,930 B1 2/2001 Ignaczak
8,337,372 B1 * 12/2012 Boterenbrood .... A63B 21/4035 482/141
8,556,781 B1 10/2013 Fitzpatrick
8,672,815 B1 3/2014 Springer
8,951,170 B1 2/2015 Tayo
D731,008 S 6/2015 Orakwusi
9,254,408 B1 2/2016 Otto
9,254,410 B1 2/2016 Mirza
9,833,654 B1 12/2017 Gant et al.
D811,497 S 2/2018 Petek
D816,782 S 5/2018 Petek
D834,660 S 11/2018 Petek
10,159,868 B2 * 12/2018 Light ..... A63B 21/072
D843,512 S 3/2019 Petek
D845,404 S 4/2019 Kuka
D898,134 S * 10/2020 Hitman ..... A63B 21/0724 D21/679
10,953,270 B2 * 3/2021 Fazzari ..... A63B 21/4035
2002/0119872 A1 * 8/2002 Greenheck ..... A63B 21/4015 482/106
2003/0130096 A1 7/2003 LaCroce
2005/0202942 A1 9/2005 De Lano
2006/0040802 A1 * 2/2006 Vittone ..... A63B 23/1263 482/106
2008/0176723 A1 * 7/2008 Johnson ..... A63B 21/0724 482/106
2010/0323854 A1 * 12/2010 Brandenburg ..... A63B 21/0724 72/367.1
2012/0028770 A1 2/2012 Barchi
2013/0035218 A1 * 2/2013 Wierszewski ..... A63B 21/072 482/106
2013/0172157 A1 7/2013 Glicksten et al.
2014/0287889 A1 * 9/2014 Grace ..... A63B 21/0783 482/106
2016/0051857 A1 * 2/2016 Rasner ..... A63B 21/4035 482/92
2017/0106226 A1 4/2017 Mann
2018/0318633 A1 11/2018 Marrs
2019/0001178 A1 * 1/2019 Wang ..... A63B 21/0726
2019/0184225 A1 6/2019 Leoniak
2020/0061407 A1 2/2020 LaCroce

* cited by examiner

EXERCISE BAR

CROSS-REFERENCE TO RELATED APPLICATIONS

This application is a continuation under 35 U.S.C. § 120 of International Application PCT/US2019/045639, filed on Aug. 8, 2019, which claims the benefit of and priority to U.S. Provisional Application No. 62/779,819, filed on Dec. 14, 2018, and is a continuation-in-part of and claims priority to U.S. Design Application No. 29/659,336, filed on Aug. 8, 2018, now U.S. Pat. No. D898,134, issued on Oct. 6, 2020, the contents of each of which are incorporated herein by reference.

FIELD OF THE INVENTION

The present disclosure generally relates to an exercise bar, and in particular an exercise bar with an adjustable handle.

BACKGROUND

There are various types of exercise bars, such as a weight lifting bar, that has a bar and weights supported by the bar. One type of bar is a so-called Swiss bar. Such a bar may include handles that are transverse to an axis of the bar and are permanently fixed to components of the bar. Users cannot change the angles of the handles to the axis of the bar or the positions of the handles in the bar.

SUMMARY

An embodiment of the present disclosure provides an exercise bar. The bar includes: a first end support; a second end support; a first handle support; and a second handle support. The second end support is spaced apart from the first end support in a first direction. The first handle support is located between the first end support and the second end support in the first direction. The second handle support is spaced apart from the first handle support in a second direction different from the first direction. The second handle support is located between the first end support and the second end support in the first direction. Each of the first handle support and the second handle support is configured to receive at least one of a plurality of adjustable handles.

Another embodiment of the present disclosure provides a system. The system includes an exercise bar having: a first end support; a second end support; a first handle support; and a second handle support. The second end support is spaced apart from the first end support in a first direction. The first handle support is located between the first end support and the second end support in the first direction. The first handle support is provided with a first recess that is configured to removably support at least one of a plurality of handles. The second handle support is spaced apart from the first handle support in a second direction different from the first direction. The second handle support is located between the first end support and the second end support in the first direction. The second handle support is provided with a second recess that is configured to removably support the at least one of a plurality of handles. The second recess and the first recess preferably face each other. The plurality of handles preferably include at least a first handle of a first length, and at least a second handle of a second length longer than the first length. When the first and second recesses removably support the first handle, the first handle extends in the second direction. When the first and second recesses removably support the second handle, the second handle extends in a direction different than the second direction.

Another embodiment of the present disclosure provides an exercise bar. The bar includes: a first end support; a second end support; a first handle support; and a second handle support. The second end support is spaced apart from the first end support in a first direction. The first handle support is located between the first end support and the second end support in the first direction. The first handle support includes a first plurality of fixation points that are configured to support at least one of a plurality of handles. The second handle support is spaced apart from the first handle support in a second direction different from the first direction. The second handle support is located between the first end support and the second end support in the first direction. The second handle support includes a second plurality of fixation points that are configured to support the at least one handle.

DETAILED DESCRIPTION OF THE PREFERRED EMBODIMENTS

Figure 1:
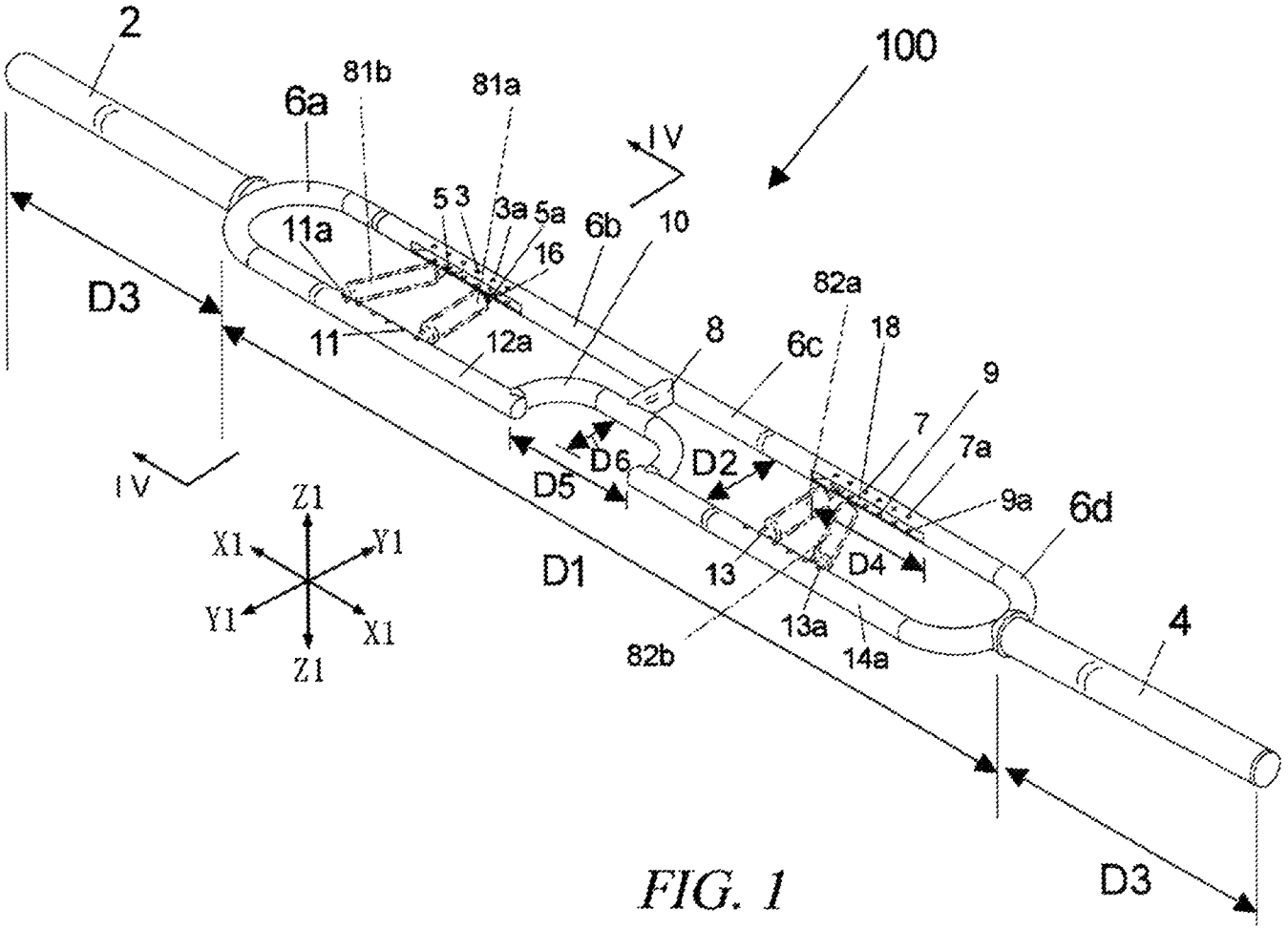
FIGS. 1-2 are perspective views of an exercise bar according to one embodiment.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 2:
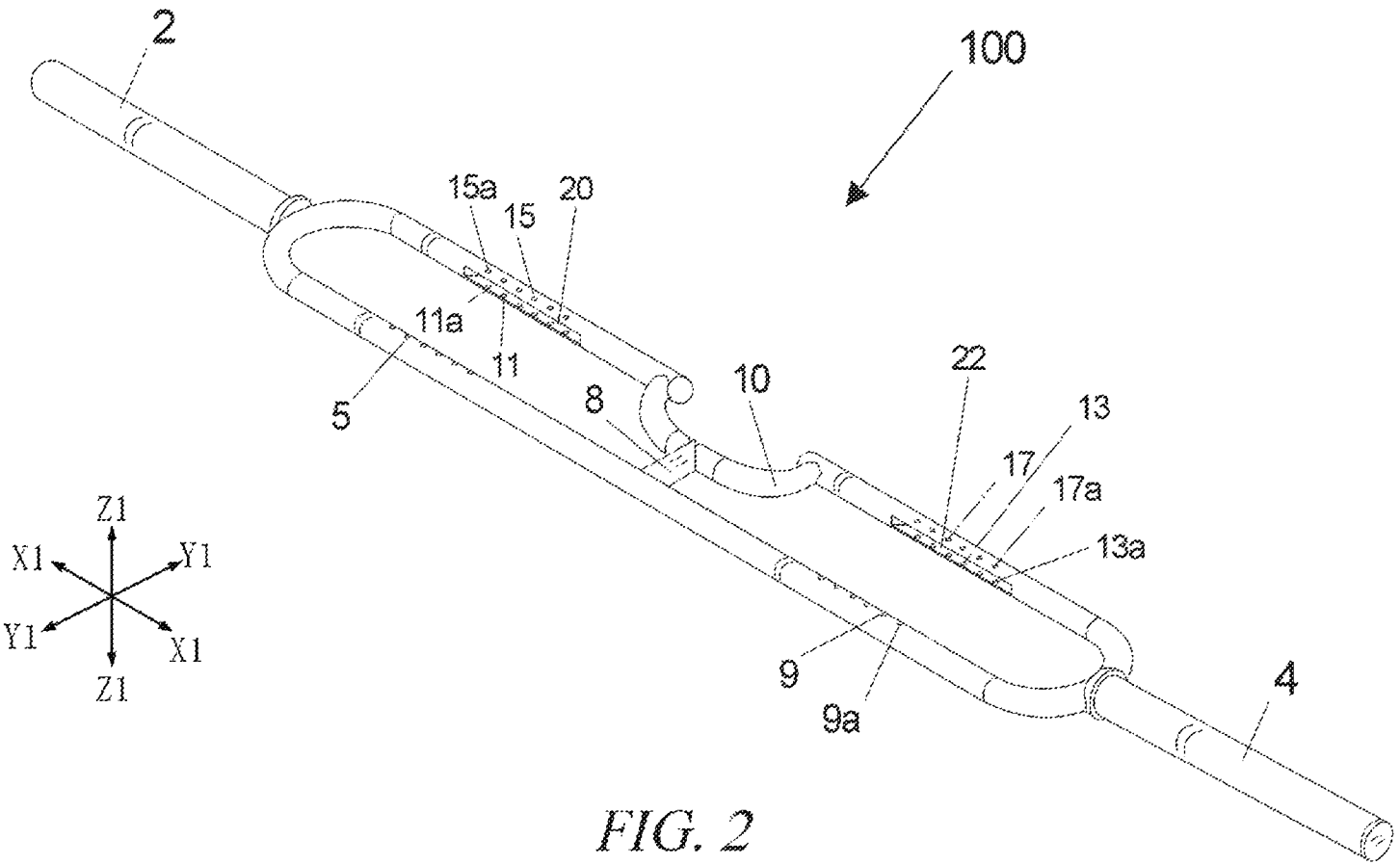

FIGS. 1-2 are perspective views of an exercise bar according to one embodiment.

Referring to FIGS. 1 and 2, the exercise bar 100 may be, but is not limited to, a weight lifting bar to support weights, such as weight lifting plates (not shown). The exercise bar 100 may be used with handles, for example, including handles 81*a*, 81*b*, 82*a*, and 82*b*. In one example, users may grip the handles, and then lift and lower the exercise bar 100 with weights applied. While the handles may be cylindrically-shaped as shown, the handles may take the shape, form or texture of a variety of objects or combination of objects such as spheres, semi-cylindrical, grooved, notched, cubes, smooth or textured or a combination of the same, or any other grippable surface or shape. The handles may be similarly-shaped across the exercise bar 100 or be comprised of a combination of shapes as desired. The handles may protrude or recess from the surface of the exercise bar 100. The handles may exhibit rotational properties or slide freely along the length of sections containing a track (e.g., recesses 16, 18, 20, and 22 described below) and pin holes (e.g., fixation points 3, 5, 7, 9, 11, 13, 15, and 17 described below). The handles may extend outside the dimensions of the exercise bar 100 yet remained anchored to the exercise bar 100. Thus, while certain shapes and configurations are described and shown, it will be understood that different shapes and/or combination of shapes may be utilized as desired.

In the illustrated example, the bar 100 may include a first end support 2, a second end support 4 spaced apart from the first end support 2 in a first direction X1, and handle supports located between the first and second end supports 2 and 4 in the first direction X1.

The handle supports may include a first handle support 6*b*, a second handle support 12*a*, a third handle support 6*c*, and a fourth handle support 14*a*. In one example, the handle supports 6*b* and 12*a* may be spaced apart from each other in a second direction Y1 different from the first direction X1. For example, the second direction Y1 may be perpendicular to the first direction X1, or may be non-perpendicular to the first direction X1 (e.g., an angle of the second direction Y1 to the first direction X1 may be 30 degrees, 45 degrees, 80 degrees, 120 degrees, or other degrees). The handle supports 6*c* and 14*a* may be spaced apart from each other in the second direction Y1. Each pair of the handle supports 6*b* and 12*a* as well as 6*c* and 14*a* may together support at least one of the handles such as handles 81*a*, 81*b*, 82*a*, and 82*b*.

In the illustrated example, the end supports 2 and 4 may each be a hollow cylinder, tube, sleeve, or other type of shape. The end supports 2 and 4 may be respectively configured to support weight lifting plates (not shown). Accordingly, each end support may be sized to receive one or more standard weight lifting plates, and may include bores for receiving pins for retaining such weight lifting plates on the corresponding end support.

The handle supports 6*b*, 12*a*, 6*c*, and 14*a* may include at least one of a straight shape, a curved shape, and other types of shape. In the illustrated example, the handle supports 6*b*, 12*a*, 6*c*, and 14*a* are straight.

In the illustrated example, the end support 2, the handle support 6*b*, and the handle support 12*a* may be connected by a first connection portion 6*a*. The connection portion 6*a* may be located between the end support 2 and each of the handle supports 6*b* and 12*a*. Similarly, the end support 4, the handle support 6*c*, and the handle support 14*a* may be connected by a second connection portion 6*d*. The connection portion 6*d* may be located between the end support 4 and each of the handle supports 6*c* and 14*a*. Further, a connection portion 10 may be provided to connect the handle supports 12*a* and 14*a*, and a connection portion 8 may be provided to connect the handle supports 10, 6*b*, and 6*c*. The connection portions 6*a*, 6*d*, 10, and 8 may include at least one of a straight shape, a curved shape, and other types of shape. In the illustrated example, the connection portions 6*a*, 6*d*, and 10 may be U-shaped, and the connection portion 8 may be straight.

The end supports 2 and 4, and the handle supports 6*b*, 6*c*, 12*a*, and 14*a*, the connection portions 6*a*, 6*d*, 8, and 10 may be integrated together as one unit as shown by FIGS. 1-2. Each of the end supports 2 and 4, and the handle supports 6*b*, 6*c*, 12*a*, and 14*a*, the connection portions 6*a*, 6*d*, 8, and 10 may be made of metal, such as a hard metal, or other type of material.

Figure 3A:
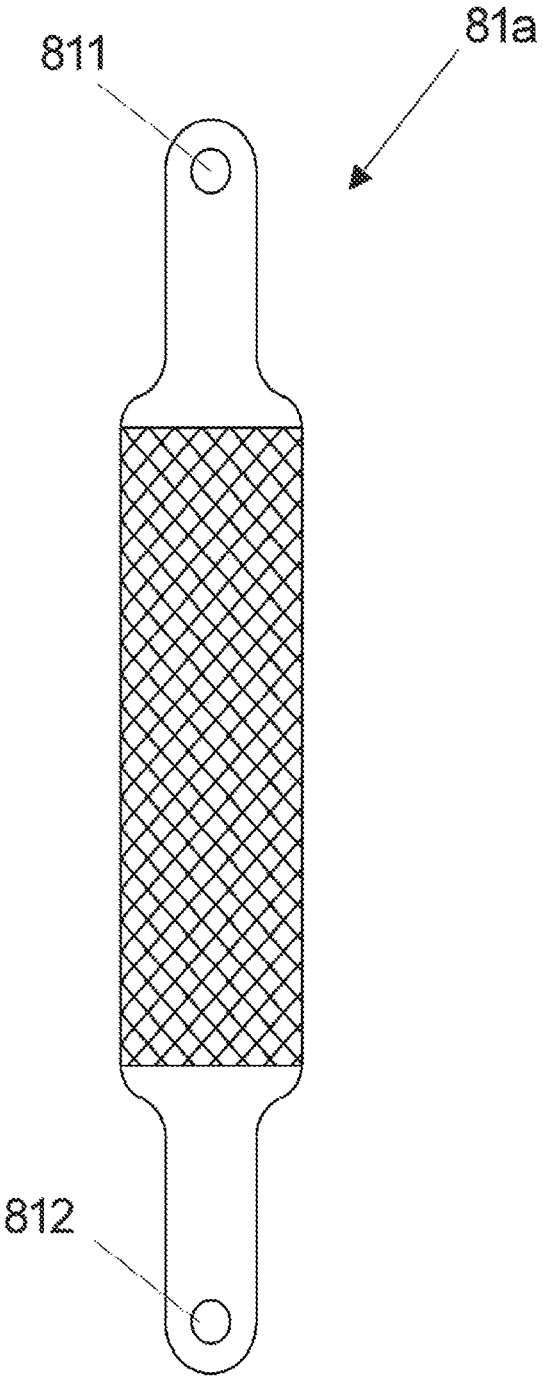
FIGS. 3A and 3B are plan views of handles according to one embodiment.

The handle supports 6*b* and 12*a* may be configured to removably support at least one of a plurality of handles that include handles 81*a* and 81*b*. The handles 81*a* and 81*b* may accommodate women and/or men, and may be made of rubber coated material, metal, some other material, or a combination thereof. The handles 81*a* and 81*b* may have different lengths. Accordingly, the first handle 81*a* has a first length and the second handle 81*b* has a second length longer than that of the first handle 81*a*. In one example, as shown in FIG. 3A, the handle 81*a* may be provided with two fixation points (e.g., bores) 811 and 812 at opposite ends of the length of the handle 81*a*. The fixation point 811 may be located at one end of the handle 81*a*, while the fixation point 812 may be located at the other end of the handle 81*a*. Similar to the handle 81*a*, the handle 81*b* may be provided with two fixation points (e.g., bores) at opposite ends of the length of the handle 81*b* (not shown).

Referring to FIG. 1, the handle support 6*b* may be provided with a recess 16. The recess 16 may be configured to removably support at least one of the plurality of handles that include handles 81*a* and 81*b*. In one example, a dimension of the recess 16 of the handle support 6*b* in the first direction X1 may be larger than a dimension of the recess 16 of the handle support 6*b* in a third direction Z1 different from the first direction X1 and the second direction Y1, thereby forming a slot. For example, the third direction Z1 may be perpendicular to the first and second directions X1 and Y1, or may be non-perpendicular to the first and second directions X1 and Y1 (e.g., an angle of the third direction Z1 to the first and second directions X1 and Y1 may be 30 degrees, 45 degrees, 80 degrees, 120 degrees, or other degrees). At a first side of the recess 16, as shown in FIG. 1, there are a plurality of fixation points 3, for example, including fixation point 3*a*. The fixation points 3 may be spaced apart from each other in the first direction X1. Each of the fixation points 3 may include a bore that passes through a part of the handle support 6*b* from the recess 16 to an outside of the handle support 6*b*. At a second side of the recess 16, as shown in FIG. 1, there are a plurality of fixation points 5, for example, including fixation point 5*a*. The second side of the recess 16 may be opposite the first side of the recess 16 in the third direction Z1, such that the combination of fixation points 3 and 5 may form bores passing completely through the handle support 6*b* in the third direction, each bore representing a discrete fixation point for a handle. The fixation points 5, similar to the fixation points 3, may therefore be spaced apart from each other in the first direction X1.

Figure 4:
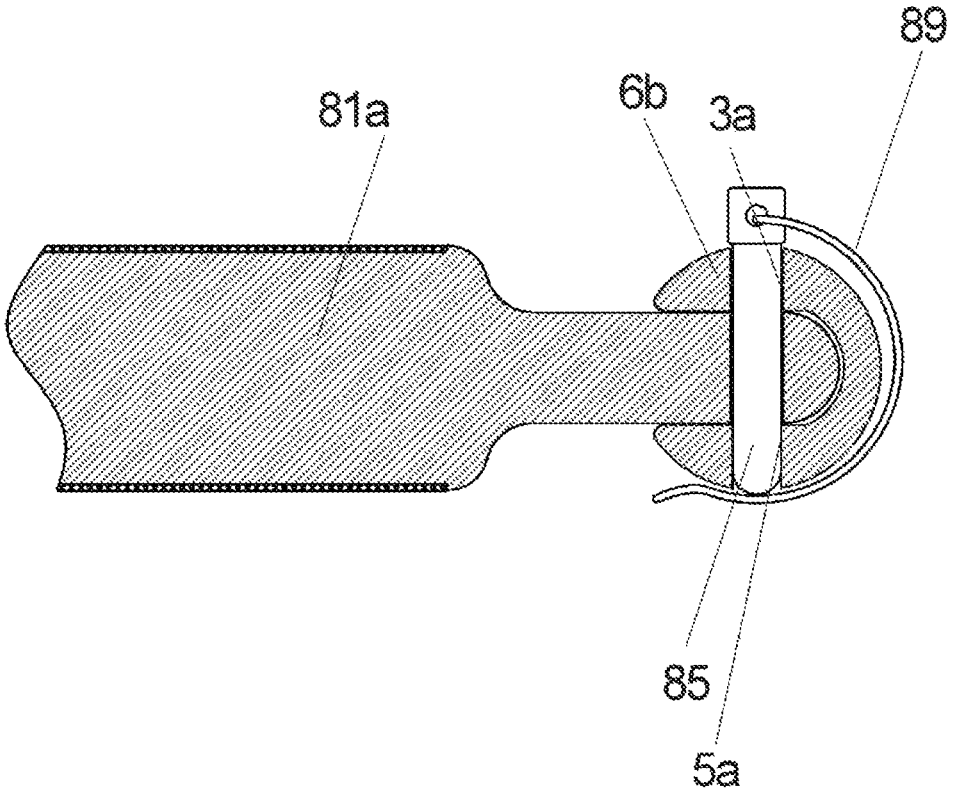
FIG. 4 is a cross sectional view taken along a line IV-IV in FIG. 1.

The handles 81*a* and 81*b* may be interchangeably or concurrently fixed to the handle support 6*b* by way of the fixation points. For example, a pin 85 (see FIG. 4) can be inserted through two corresponding aligned bores of the fixation points, such as through fixation points 3*a* and 5*a* which are aligned with each other, and through the bore of the fixation point 811 of one of the handles 81*a* and 81*b*. As shown in FIG. 4, the pin 85 may be fixed to the handle support 6*b* by a fixing member 89, such as a metal spring or other type of fixing member. When the pin is inserted into the bores of the fixation points 3*a* and 5*a*, so that it resides, at least partially in the bores of the fixation points 3*a* and 5*a* at the same time, the inserted pin 85 may be different from the length D1+D3+D3, shown in FIG. 1 of the bar 1.

Referring to FIG. 2, the handle support 12*a* may be provided with a recess 20 positioned opposite the recess 16 of handle support 6*b*. The recess 20 may be configured to removably support at least one of the plurality of handles that include handles 81*a* and 81*b*. The recess 20 and the recess 16 may face to each other. In one example, a dimension of the recess 20 of the handle support 12*a* in the first direction X1 may be larger than a dimension of the recess 20 of the handle support 12*a* in the third direction, thereby forming a slot. At a first side of the recess 20, as shown in FIG. 2, there are a plurality of fixation points 11, for example, including fixation point 11*a*. The fixation points 11 may be spaced apart from each other in the first direction X1. Each of the fixation points 11 may include a bore that passes through a part of the handle support 12*a* from the recess 20 to an outside of the handle support 12*a*. At a second side of the recess 20, as shown in FIG. 2, there are a plurality of fixation points 15, for example, including fixation point 15*a*. Accordingly, the fixation points 11 and 15 may be similar in form to the fixation points 3 and 5 of handle support 6*b*.

The handles 81*a* and 81*b* may be interchangeably or concurrently fixed to the handle support 12*a* by way of the fixation points. For example, a pin (which may be the same as or similar to the pin 85 discussed above) can be inserted through two corresponding aligned bores of the fixation points, such as through fixation points 11*a* and 15*a* which are aligned with each other, and through the bore of the fixation point 812 of one of the handles 81*a* and 81*b*. When the pin is inserted into the bores of the fixation points 11*a* and 15*a*, so that it resides, at least partially in the bores of the fixation points 11*a* and 15*a* at the same time, the inserted pin may be different from the length D1+D3+D3, shown in FIG. 2 of the bar 1.

When the recesses 16 and 20 removably support the handle 81*a*, the handle 81*a* may extend in the second direction Y1, and when the recesses 16 and 20 removably support the handle 81*b*, the handle 81*b* may extend in a direction different than the second direction Y1. In one example, the lengths of the handles 81*a* and 81*b* may be configured such that when the handle 81*a* is held by a first fixation point of the fixation points 3 of the handle support 6*b*, the handle 81*a* may connect to a first fixation point of the fixation points 11 of the handle support 12*a* directly opposite the first fixation point of handle support 6*b*, and when the handle 81*b* is held by the first fixation point of the fixation points 3 of the first handle support 6*b*, the handle 81*b* may connect to a second fixation point of the fixation points 11 of the handle support 12*a* offset from the first fixation point of handle support 6*b*.

Figure 3B:
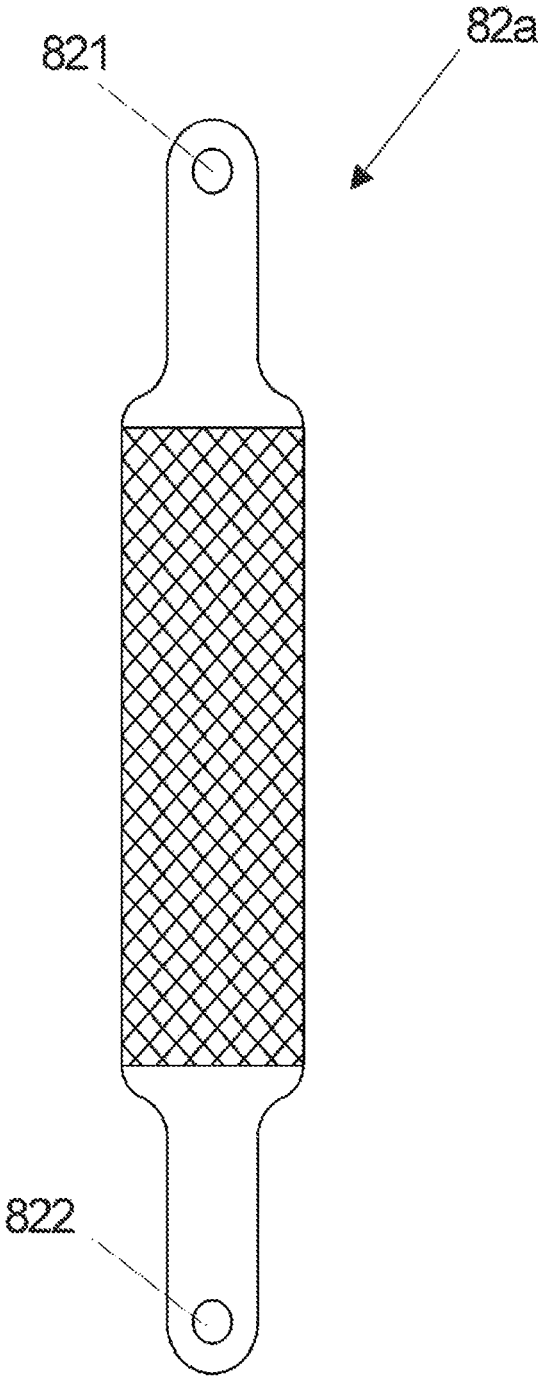

Relationships between the handle supports 6*b* and 12*a* discussed above may be similar to relationships between the handle supports 6*c* and 14*a*. The handle supports 6*c* and 14*a* may be configured to removably support at least one plurality of handles that include handles 82*a* and 82*b*. The handles 82*a* and 82*b* may accommodate women and/or men, and may be made of rubber coated and metal. The handles 82*a* and 82*b* may have different lengths. A handle 82*a* of the handles 82 has a first length. The first length of the handle 82*a* may be the same as the first length of the handle 81*a*. A handle 82*b* of the handles 82 has a second length longer than the handle 82*a*. The second length of the handle 82*b* may be the same as the second length of the handle 81*b*. As shown in FIG. 3B, each handle 82 may be provided with two fixation points (e.g., bores) 821 and 822 at opposite ends of the length of the handle 82. The fixation point 821 may be located at one end of the handle 82, while the fixation point 822 may be located at the other end of the handle 82.

The structure of the opposing handle supports 6*c* and 14*a* is similar to the structure of the handle supports 6*b* and 12*a*, as stated above. Elements 6*c*, 18, 7, 7*a*, 9, and 9*a* may correspond to the elements 6*b*, 16, 3, 3*a*, 5, and 5*a*, respectively. Elements 14*a*, 22, 13, 13*a*, 17, and 17*a* may correspond to the elements 12*a*, 20, 11, 11*a*, 15, and 15*a*, respectively. Handles 82*a* and 82*b* may correspond to the handles 81*a* and 81*b*, respectively.

The fixation points 3*a*, 5*a*, 11*a*, and 15*a*, etc. of the handle supports are not limited to bores shown in FIGS. 1-2, but may include projections (not shown).

In one example, each of the end supports 2 and 4 may have a length D3, which may be, but is not limited to, about sixteen inches plus or minus one inch. The length of the combination of the handle supports 6*b* and 6*c* and the connection portions 6*a* and 6*d* may be about D1, which may be, but is not limited to, fifty-two inches.

Referring to FIG. 1, in at least one embodiment the connection portion 10 may provide a crescent curve (for clearance of the head/chin) in the center of the bar 100 for overhead pressing that makes an overhead press movement more efficient, safe, and advantageous to weight lifters.

In one example, the distance between the handle supports 6*b* and 12*a* and the distance between the handle supports 6*c* and 14*b* may be about D2, which may be, but is not limited to, between one hundred fifteen and one hundred sixty millimeters. The bar 100 may have a total length (equal to D3+D1+D3 shown in FIG. 1), which may be, but is not limited to, eighty-four inches plus or minus two inches. The weight of the unloaded bar 1 may be, but is not limited to, fifty pounds in at least one embodiment.

In one example, the distance D1 between the end supports 2 and 4 may be, but is not limited to, about fifty-two inches. Each of the end supports 2 and 4 may have a length D3, which may be, but is not limited to, sixteen inches plus or minus one inch. Each of the sleeves or cylinders 2 and 4 may have a sleeve outer diameter, which may be, but is not limited to, 49.75 millimeters. The width D5 of the head chin clearance or connection portion 10 may be, but is not limited to, eight inches, plus or minus two inches. The depth D6 of the head/chin clearance may be, but is not limited to, about 3.5 inches, plus or minus 0.5 inches.

In one example, the most narrow pin position in FIG. 1, i.e. the pin position corresponding the openings of fixation points 3 and 5 may be, but is not limited to, 8.5 inches from the connection portion 8 plus or minus two inches. The widest pin position, such as the pin position for openings 3*a* and 5*a*, may be, but is not limited to, forty-four inches, plus or minus two inches. The distance between adjacent pin positions, or adjacent openings of fixation points 3, 5, 7, 9, 11, 13, 15, and 17 may be, but is not limited to, one inch, plus or minus 0.5 inches. The rail diameter or diameter of each of portions 6*a*-6*d*, 12*a*-*b*, and 14*a*-*b* may be, but is not limited to, thirty millimeters. Dimensions of the elements of the bar are not limited to the dimensions described here, and may have other dimensions.

In the present embodiment, the recesses 16 and 20 may be configured to removably support at least one handle, for example, including the handles 81*a* and 81*b*, to easily be switched in and out and position to be adjusted effortlessly. Therefore, users can easily change and adjust the angles of the handle to the direction X1 and/or the positions of the handle in the bar 1. The recesses 18 and 22 may be configured to removably support at least one handle, for example, including the handles 82*a* and 82*b*, to easily be switched in and out and position to be adjusted effortlessly. Therefore, users can easily change and adjust the angles of the handle to the direction X1 and/or the positions of the handle in the bar 1.

Each of the recesses 16, 18, 20, and 22 may be thirteen millimeters tall, eighteen millimeters deep and runs a length of D4, and provide an adjustable portion of the bar 100 (i.e. from most narrow to most wide pin position).

Figure 5:
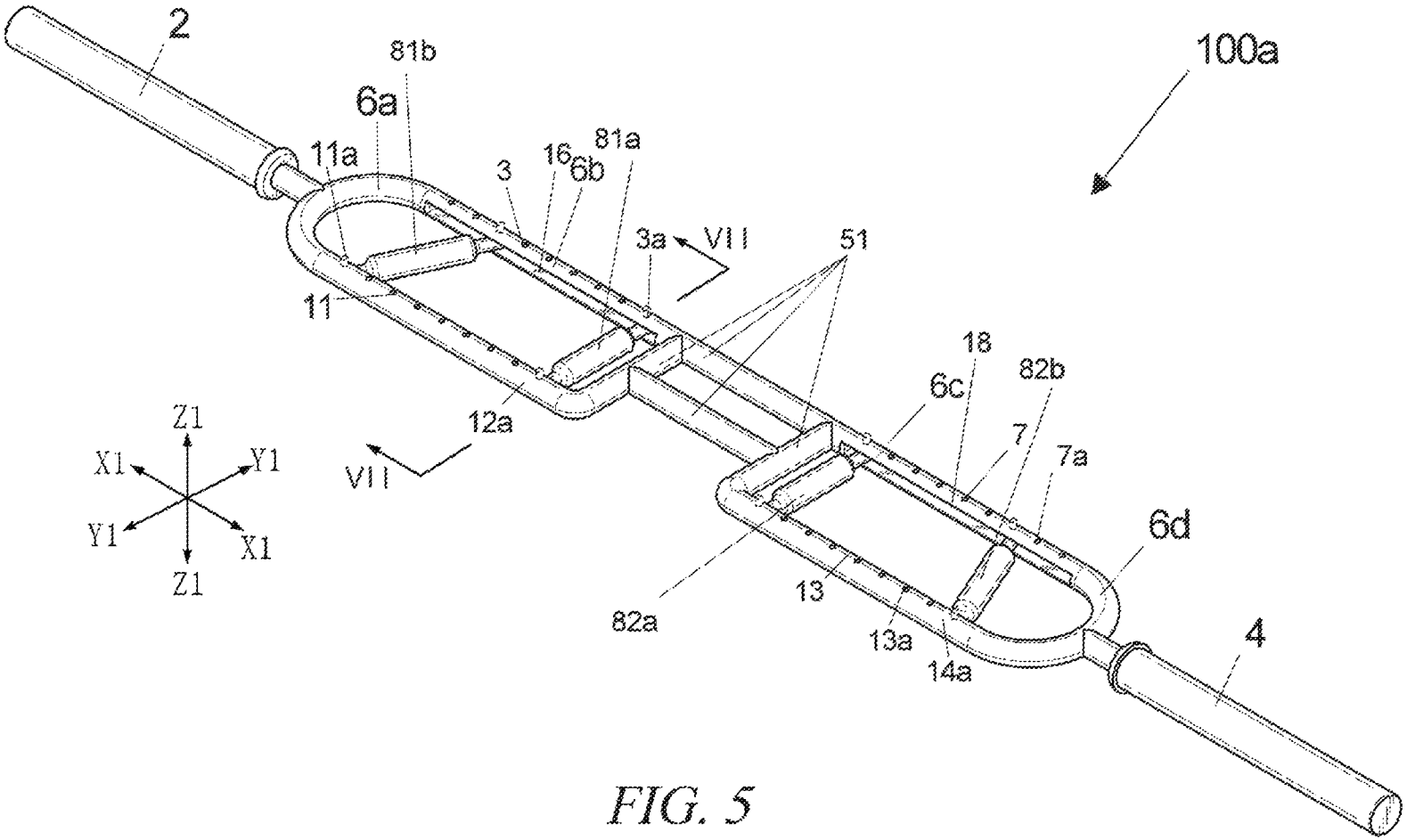
FIGS. 5-6 are perspective views of an exercise bar according to one embodiment.
Figure 6:
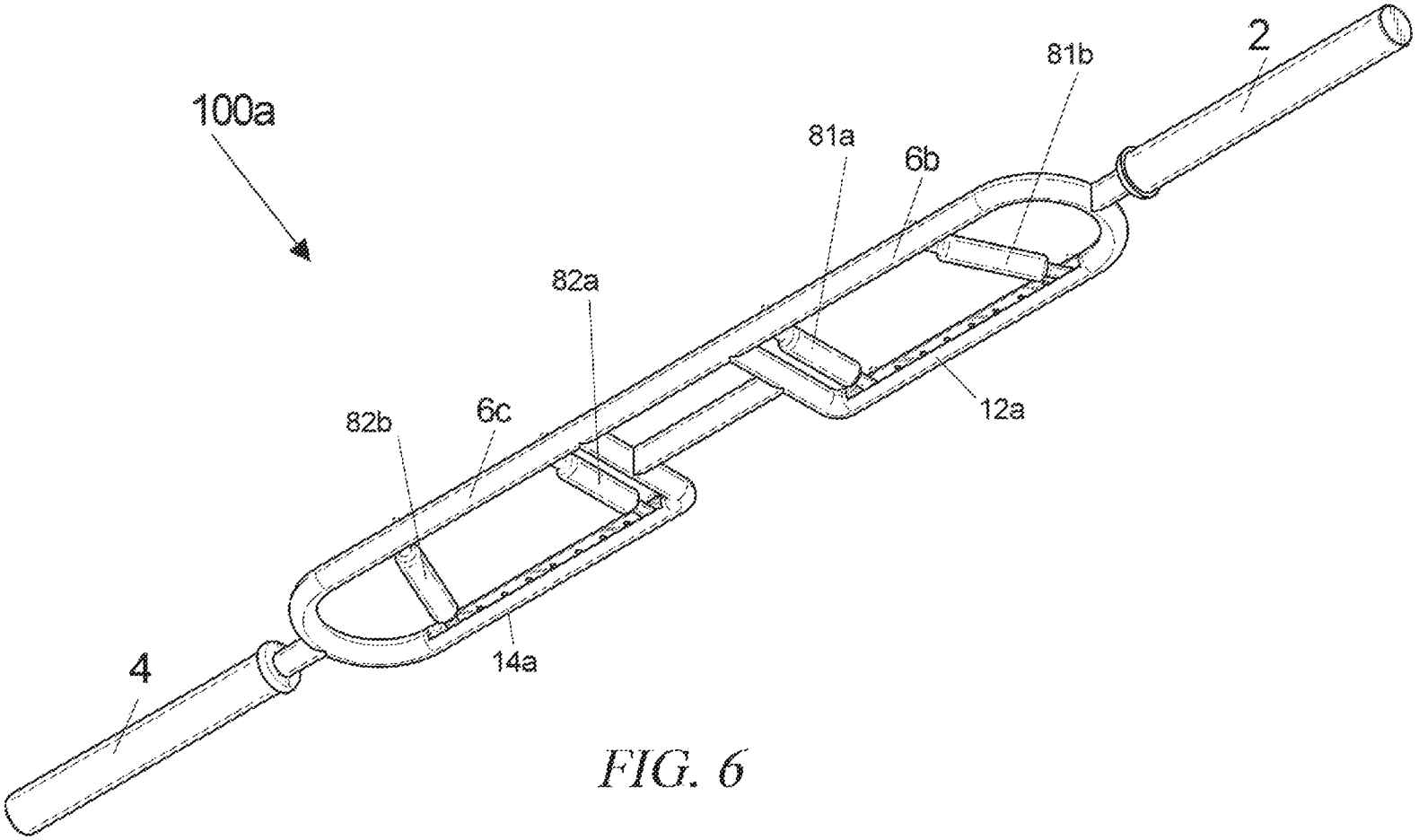
Figure 7:
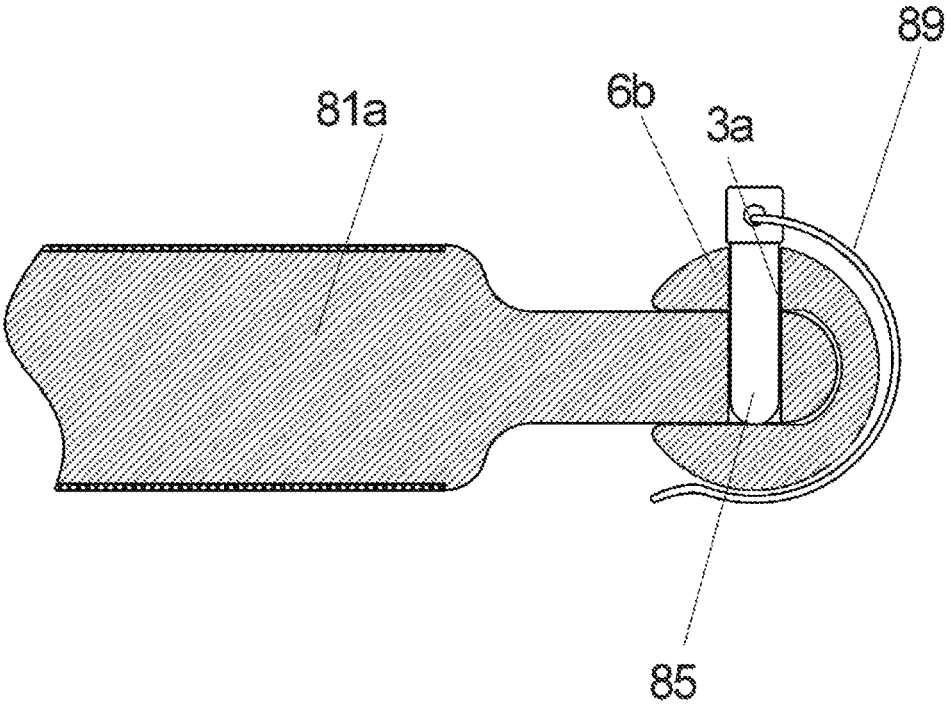
FIG. 7 is a cross sectional view taken along a line VII-VII in FIG. 5.

FIGS. 5-6 illustrate perspective views of another example of an exercise bar of one embodiment. FIG. 7 illustrates a cross sectional view of the exercise bar of FIG. 5.

The bar 100*a* in FIGS. 5-6 is substantially the same as the bar in FIGS. 1-2, other than that the bar 100*a* in FIGS. 5-6 does not include the fixation points (e.g., bores) 5, 15, 9, and 17 shown in FIGS. 1-2 and that the bar 100*a* in FIGS. 5-6 includes connection portions 51 instead of the connection portions 8 and 10 in the bar 100 in FIGS. 1-2.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. An exercise bar comprising:

a first end support;

a second end support spaced apart from the first end support in a first direction;

a first handle support located between the first end support and the second end support in the first direction; and a second handle support spaced apart from the first handle support in a second direction different from the first direction, the second handle support being located between the first end support and the second end support in the first direction, wherein each of the first handle support and the second handle support is configured to receive at least one of a plurality of adjustable handles, wherein the first handle support is provided with a first recess that is configured to removably support the at least one of the plurality of adjustable handles, wherein the first handle support is provided with a plurality of first bores at a first side of the first recess, the first bores of the first handle support being spaced apart from each other in the first direction, and wherein each of the first bores of the first handle support passes through a part of the first handle support from the first recess to an outside of the first handle support.

2. The exercise bar of claim 1, wherein the second handle support is provided with a second recess that is configured to removably support the at least one of the plurality of adjustable handles, the second recess and the first recess facing each other.

3. The exercise bar of claim 2, wherein the second handle support is provided with a plurality of first bores at a first side of the second recess, the first bores of the second handle support being spaced apart from each other in the first direction.

4. The exercise bar of claim 3, wherein the first handle support is provided with a plurality of second bores at a second side of the first recess, the second side of the first recess being opposite to the first side of the first recess in a third direction different from the first and second directions, and the second handle support is provided with a plurality of second bores at a second side of the second recess, the second side of the second recess being opposite to the first side of the second recess in the third direction.

5. The exercise bar of claim 4, wherein the first bores of the first handle support are respectively aligned with the second bores of the first handle support as viewed in the third direction, and the first bores of the second handle support are respectively aligned with the second bores of the second handle support as viewed in the third direction.

6. The exercise bar of claim 3, wherein each of the first bores of the second handle support passes through a part of the second handle support from the second recess to an outside of the second handle support.

7. The exercise bar of claim 2, wherein a length of the first recess of the first handle support in the first direction is larger than a length of the first recess of the first handle support in a third direction different from the first and second directions.

8. The exercise bar of claim 1, wherein each of the first handle support, the second handle support, the first end support, and second end support includes a straight portion extending along the first direction.

9. The exercise bar of claim 3, further comprising:

a first handle of the at least one of the plurality of adjustable handles, the first handle being held by the first recess of the first handle support and the second recess by the second handle support, the first handle being provided with two bores;

a first pin inserted into one of the two bores of the first handle and into one of the first bores of the first handle support; and a second pin inserted into the other one of the two bores of the first handle and into one of the first bores of the second handle support.

10. The exercise bar of claim 2, further comprising:

a third handle support located between the second end support and each of the first and second handle supports in the first direction, the third handle support being provided with a third recess that is configured to removably support at least one of the plurality of adjustable handles; and a fourth handle support spaced apart from the third handle support in the second direction, the fourth handle support being located between the second end support and each of the first and second handle supports in the first direction, the fourth handle support being provided with a fourth recess that is configured to removably support at least one of the plurality of adjustable handles, the fourth recess and the third recess facing each other.

11. A system comprising:

an exercise bar having:

a first end support;

a second end support spaced apart from the first end support in a first direction;

a first handle support located between the first end support and the second end support in the first direction, the first handle support being provided with a first recess that is configured to removably support at least one of a plurality of handles; and a second handle support spaced apart from the first handle support in a second direction different from the first direction, the second handle support being located between the first end support and the second end support in the first direction, the second handle support being provided with a second recess that is configured to removably support the at least one of the plurality of handles, the second recess and the first recess facing each other, wherein the at least one of the plurality of handles comprises at least a first handle of a first length, and at least a second handle of a second length longer than the first length, wherein when the first and second recesses removably support the first handle, the first handle extends in the second direction, and when the first and second recesses removably support the second handle, the second handle extends in a direction different than the second direction, wherein the first handle support is provided with a first plurality of discrete fixation points within the first recess, the first plurality of discrete fixation points of the first handle support being spaced apart from each other in the first direction, wherein each of the first plurality of discrete fixation points comprises a bore through the first handle support in a third direction different from the first and second directions, and wherein each of the bores of the first handle support passes through a part of the first handle support from the first recess to an outside of the first handle support.

12. The system of claim 11, wherein the second handle support is provided with a second plurality of discrete fixation points, the second plurality of discrete fixation points of the second handle support being spaced apart from each other in the first direction.

13. The system of claim 12, wherein each of the second plurality of discrete fixation points comprises a bore through the second handle support in the third direction.

14. The system of claim 13, wherein each of the bores of the second handle support passes through a part of the second handle support from the second recess to an outside of the second handle support.

15. The system of claim 11, wherein a length of the first recess of the first handle support in the first direction is larger than a length of the first recess of the first handle support in a third direction different from the first and second directions.

16. The system of claim 13, wherein each of the first and second handles is provided with two bores at opposite ends of the first length and the second length respectively;

a first pin inserted into one of the two bores of one of the first and second handles and into one of the bores of the first handle support; and a second pin inserted into the other one of the two bores of the one of the first and second handles and into one of the bores of the second handle support.

17. The system of claim 11, further comprising:

a third handle support located between the second end support and each of the first and second handle supports in the first direction, the third handle support being provided with a third recess that is configured to removably support at least one of the plurality of handles; and a fourth handle support spaced apart from the third handle support in the second direction, the fourth handle support being located between the second end support and each of the first and second handle supports in the first direction, the fourth handle support being provided with a fourth recess that is configured to removably support at least one of the plurality of handles, the fourth recess and the third recess facing each other, and the at least one of the plurality of handles further comprising at least a third handle of the first length and a fourth handle of the second length.

18. An exercise bar comprising:

a first end support;

a second end support spaced apart from the first end support in a first direction;

a first handle support located between the first end support and the second end support in the first direction, the first handle support including a first plurality of fixation points that are configured to support at least one of a plurality of handles; and a second handle support spaced apart from the first handle support in a second direction different from the first direction, the second handle support being located between the first end support and the second end support in the first direction, the second handle support including a second plurality of fixation points that are configured to support the at least one of the plurality of handles, wherein the first plurality of fixation points is provided within a first recess that is configured to removably support the at least one of the plurality of handles, wherein the first plurality of fixation points respectively comprises a plurality of first bores at a first side of the first recess, the plurality of first bores of the first handle support being spaced apart from each other in the first direction, and wherein each of the plurality of first bores of the first handle support passes through a part of the first handle support from the first recess to an outside of the first handle support.

19. The exercise bar of claim 18, further comprising:

a first handle of the at least one of the plurality of handles having a first length such that when the first handle is held by a first fixation point of the first plurality of fixation points of the first handle support, the first handle connects to a first fixation point of the second plurality of fixation points of the second handle support, and a second handle of the at least one of the plurality of handles having a second length, such that when the second handle is held by a second fixation point of the first plurality of fixation points of the first handle support, the second handle connects to a second fixation point of the second plurality of fixation points of the second handle support, wherein the first and second handles are interchangeably fixed to the first and second handle supports by way of the first and second plurality of fixation points.

20. The exercise bar of claim 18, further comprising:

a third handle support located between the second end support and each of the first and second handle supports in the first direction, the third handle support including third fixation points that are configured to removably support at least one of the plurality of handles; and a fourth handle support spaced apart from the third handle support in the second direction, the fourth handle support being located between the second end support and each of the first and second handle supports in the first direction, the fourth handle support including fourth fixation points that are configured to removably support at least one of the plurality of handles.

21. An exercise bar comprising:

a first end support;

a second end support spaced apart from the first end support in a first direction;

a first handle support including a portion located between the first end support and the second end support in the first direction; and a second handle support including a portion spaced apart from the first handle support in a second direction different from the first direction, the second handle support including a portion located between the first end support and the second end support in the first direction, wherein each of the first handle support and the second handle support is configured to support at least one of a plurality of adjustable handles, wherein the first handle support is provided with a first cavity, wherein the first handle support is provided with a plurality of first holes, the plurality of first holes of the first handle support being spaced apart from each other in the first direction, and wherein each of the plurality of first holes of the first handle support passes through a part of the first handle support from the first cavity to an outside of the first handle support to removably support the at least one of the plurality of adjustable handles.

22. The exercise bar of claim 21, wherein the second handle support is provided with a second cavity, wherein the second handle support is provided with a second plurality of first holes, the second plurality of first holes being spaced apart from each other in the first direction, and wherein each of the second plurality of first holes passes through a part of the second handle support from the second cavity to an outside of the second handle support to removably support the at least one of the plurality of adjustable handles.

23. The exercise bar of claim 21, wherein each of the first handle support, the second handle support, the first end support, and second end support includes a straight portion extending along the first direction.

* * * * *